US006015070A

United States Patent [19]

Barto, Jr. et al.

[11] Patent Number: 6,015,070

[45] Date of Patent: Jan. 18, 2000

[54] PORTABLE BOW MAKING MACHINE

[75] Inventors: Robert M. Barto, Jr., Palm Beach Gardens; Ira L. Lopata, Palm Beach, both of Fla.

[73] Assignee: Cromwell Corporation, Riviera Beach, Fla.

[21] Appl. No.: 09/286,567

[22] Filed: Apr. 5, 1999

[51] Int. Cl.[7] ..... A41M 43/00

[52] U.S. Cl. ..... 223/46; 223/48; 28/147

[58] Field of Search ..... 223/1, 44, 46; 428/4; 28/147

[56] References Cited

U.S. PATENT DOCUMENTS

| | | | |
|---|---|---|---|
| 2,905,368 | 9/1959 | Runyan | 223/46 |
| 3,501,364 | 3/1970 | Rowland | 223/46 |
| 4,896,802 | 1/1990 | Nanami | 223/46 |
| 5,072,865 | 12/1991 | Lyons | 223/46 |
| 5,261,578 | 11/1993 | Monhan | 223/46 |
| 5,297,705 | 3/1994 | Scmidt | 223/46 |
| 5,407,108 | 4/1995 | Hambright | 223/46 |

*Primary Examiner*—Bibhu Mohanty
*Attorney, Agent, or Firm*—Norman Friedland

[57] ABSTRACT

A portable bow making machine with three clutches controlling the size, arc generation and a no-back clutch assuring that the belt driving the impaler assembly doesn't go into reverse The user requiring no particular skill, merely threads the ribbon in a channel under the reciprocal carriage and the two stroke operation automatically makes one of the loops of the bow. Stroking continues until the bow is complete and a stapler automatically retracts the needles of the impaler and the staple is forced against an anvil to secure the bow. The stapler is configured to hold a removable self-gluing card that is concomitantly attached to the bow. The forward stroke carries a carriage and clapper along the carriage slides, The clapper reaches a predetermined point and drops onto the impaler to secure each of the loops to the bow. The return stroke repositions the carriage for the next forward stroke.

20 Claims, 8 Drawing Sheets

PORTABLE BOW MAKING MACHINE

TECHNICAL FIELD

This invention relates to a bow making machine that makes the bow from a continuous ribbon material which machine is portable and intended for consumer use and particularly capable of use in the home by the housewife or someone not particular versed in the technical operation of machinery.

BACKGROUND OF THE INVENTION

As discussed in U.S. Pat. No. 3,225,976 granted to Goldfarb on Dec. 28, 1965 entitled "Bow Making Machinery" the bow making machine for the use in the home must be simple and inexpensive so that the average housewife can operate such machine merely on the basis of an instruction booklet and can afford to purchase one for such a specific use. Furthermore, as discussed in this patent, the machine must be simple in structure to minimize or eliminate the necessity of servicing or in other words, it requires no particular skills to repair the same. The type of machine contemplated in the referenced patent, which is incorporated herein by reference, is adapted to be operated intermittently rather than substantially automatically so that the operator maintains full control of the operation at all times.

The art is replete with patents that relate to bow making apparatus either for commercial application or for home use. This patent application is only concerned with the type of bow making machine that is intended for and capable of home use rather than the complex bow making machines that are identified for use in large scale manufacturing. For example, the co-inventor, Lopata, has invented several industrial types of bow making machines described in U.S. Pat. Nos. 3,396,880 and 3,415,429 granted on Aug. 13, 1968 and Dec. 10, 1968, respectively and both entitled "Apparatus and Method for Making Looped Ribbon Ornaments". A perusal of these patents make it obvious that these types of machines are complex, expensive and not capable of home use by an unsophisticated operator.

We have found that we can provide a bow making machine that is inexpensive, easy to operate and reliable. The cost of the machine in relative terms will be absorbed merely by making the number or bows provided by the roll of ribbon accompanying the portable bow making machine when purchased. It is contemplated by this invention that the user merely has to thread the machine, a simple operation and move the carriage reciprocally. At the completion of the desired bow configuration, the stapler, which includes a releasable self-gluing card, is swung in position and depressed to staple the card to the bow and automatically hold the bow in place as a finished product.

In accordance with this invention, the bow making machine consists essentially of three simple clutches that will be explained in detail hereinbelow that serve to make the operation automatic and allow for the simple movement by the operator.

SUMMARY OF THE INVENTION

An object of this invention is to provide a portable bow making machine that is capable of use by the consumer for home or like use. The machine is characterized as being simple to use, inexpensive and durable.

A feature of this invention is the provision of three clutches that make the bow making a simple task by the reciprocating motion of the carriage movable by the operator.

Another feature of this invention is the provision of the deploy able impaler needles that are retracted automatically by the simple operation of the stapler.

Another feature of this invention is the provision of adjustments for controlling the range for determining the arc of each bow and for the width of the ribbon.

The foregoing and other features of the present invention will become more apparent from the following description and accompanying drawings.

DETAILED DESCRIPTION OF THE INVENTION

Figure 1:
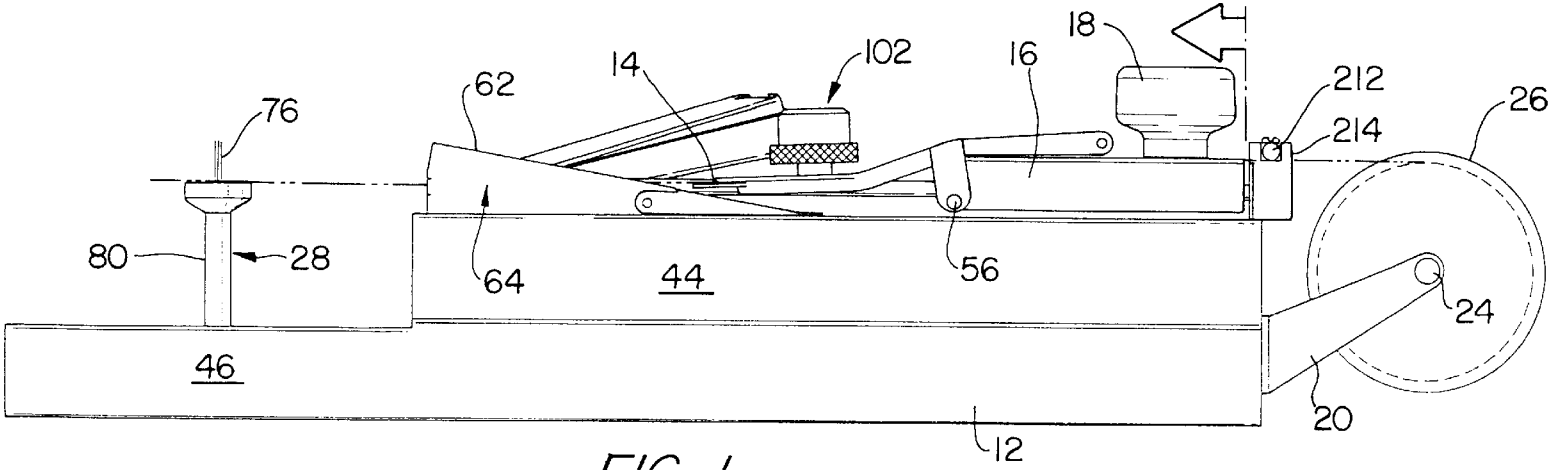
FIG. 1 is a view in elevation of the invention when the ribbon is inserted and the operation is at the beginning of the first stroke.

While this invention is being described as a machine that is particularly efficacious for use by the homemaker, as one skilled in this art will appreciate the machine can be utilized for other consumers. Of particular note is the fact that the ribbon that is contemplated for use in this machine is either made from a synthetic material or a cloth material and the types of bows that are contemplated to be made by this machine are the starpoint, confetti, petal and five point bows. These types of bows are considered as being the quality types of bows. Hence, as described above when the relative cost of the bow making machine is compared with other bow making machines, one must consider the quality of the bow when making a comparison.

The bow making machine of this invention is best understood by referring to all the Figs. where the bow making machine is generally illustrated by reference numeral 10 as comprised of the base 12, clapper 14, slide carriage 16, handle 18, ribbon spool holder 20, axle 24, mounted in the spaced brackets 22 (only one being shown) for supporting the roll of ribbon 26 and the impaler needle assembly generally indicated by reference numeral 28.

Figure 5:
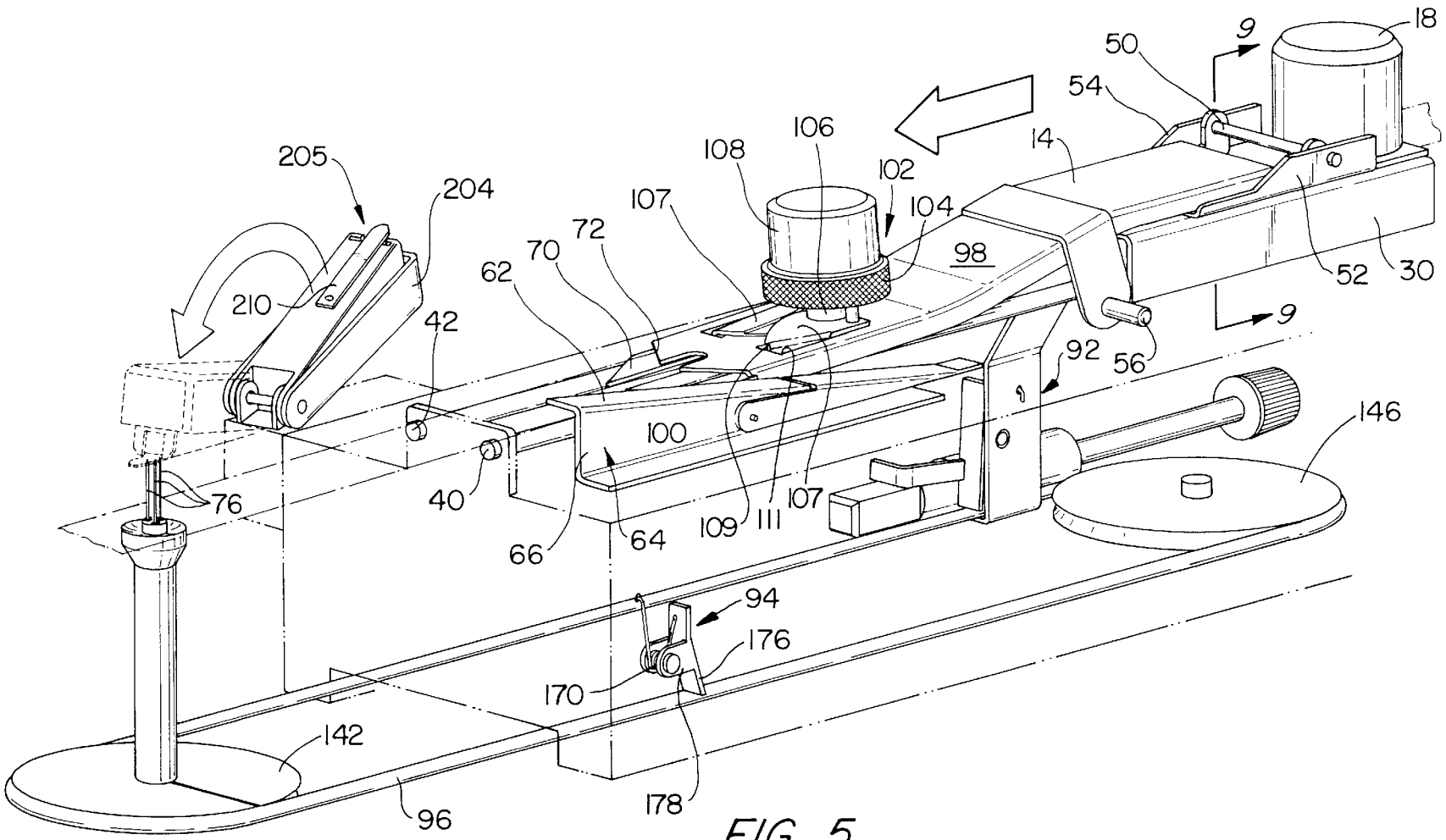
FIG. 5 is a view in perspective and phantom at the start of the stroke.
Figure 6:
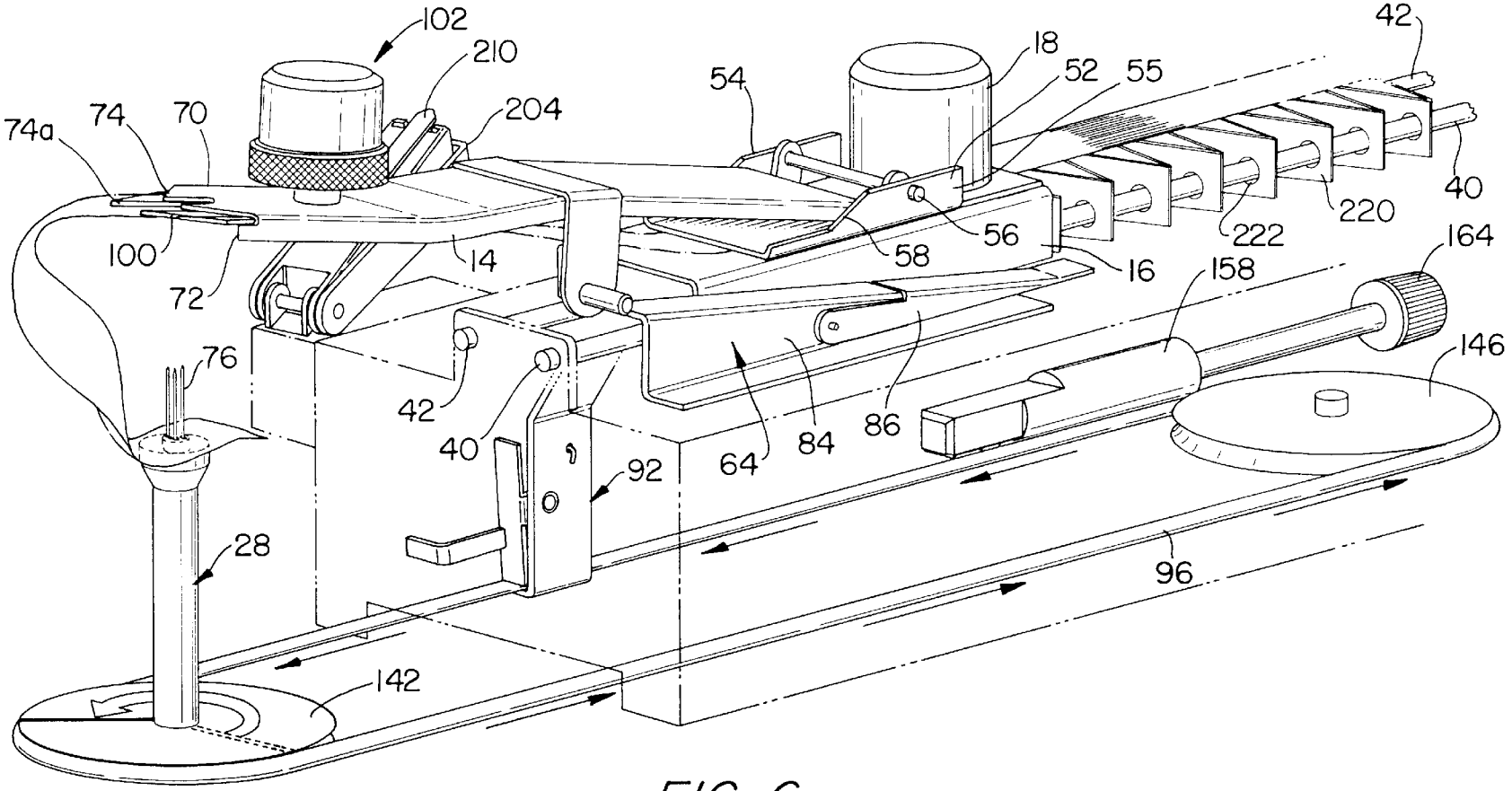
FIG. 6 is a view in perspective and phantom looking at the top of the machine.

The carriage 16 is configured as a rectangular hollow box 30 having a top flat wall 32, opposing side walls 34 and 36 and opposing end walls 38 and 39. The end walls include two pairs of aligned holes or apertures 38 that may include bearing members 41 for slidably mounting the carriage 16 on a pair of parallelly disposed rails 40 and 42 (FIGS. 5 & 6). Rails 40 and 42 extend longitudinally and are suitably supported to base 12 for guiding the carriage 16 for a two-stroke rectilinear motion of carriage 16 as will be described hereinbelow. Base 12 is configured to have two different levels. The higher level 44 extends axially only partly the extent of the base 12. The lower level 46 serves a particular function as will be fully explained hereinbelow. The impaler needle assembly 28 is supported to the base 12 in the lower level 46.

As best seen in FIG. 5 the clapper 14 is pivotally supported to the carriage 16 by the axle 50 that is supported to the upstanding spaced members 52 and 54 of guide plate 55. Cam follower 56 extending laterally relative to carriage 16 is supported to the clapper 14 by the bracket 58 suitable attached thereto or may be made integral therewith. The cam follower 56 obviously moves with the carriage 16 and clapper 14 and rides up the inclined surface 62 of cam 64 during the forward stroke. The cam 64 is suitably affixed to the base 12 at the upper level 44. As noted in FIG. 5, cam 64 is made from sheet metal or other relatively thin material that is bent in a generally "Z" shape or any other suitable shape where the upper portion is contoured on the horizontal plane to form the inclined cam surface 62 and is spaced away from the main body portion 66. This allows the cam follower 56 to ride underneath the inclined cam surface 62 when in the reverse stroke.

Figure 2:
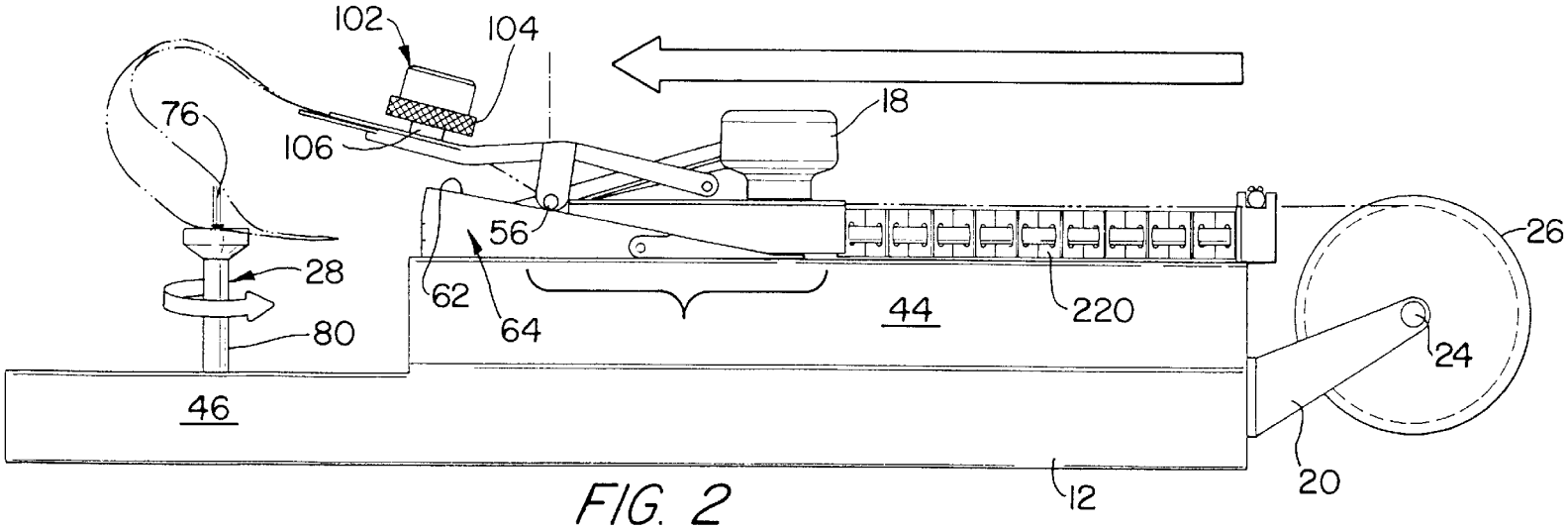
FIG. 2 is a view in elevation identical to FIG. 1 when the operation is at the mid-stroke and the clapper is part way up the inclined cam just before dropping onto the impaler needles.
Figure 3:
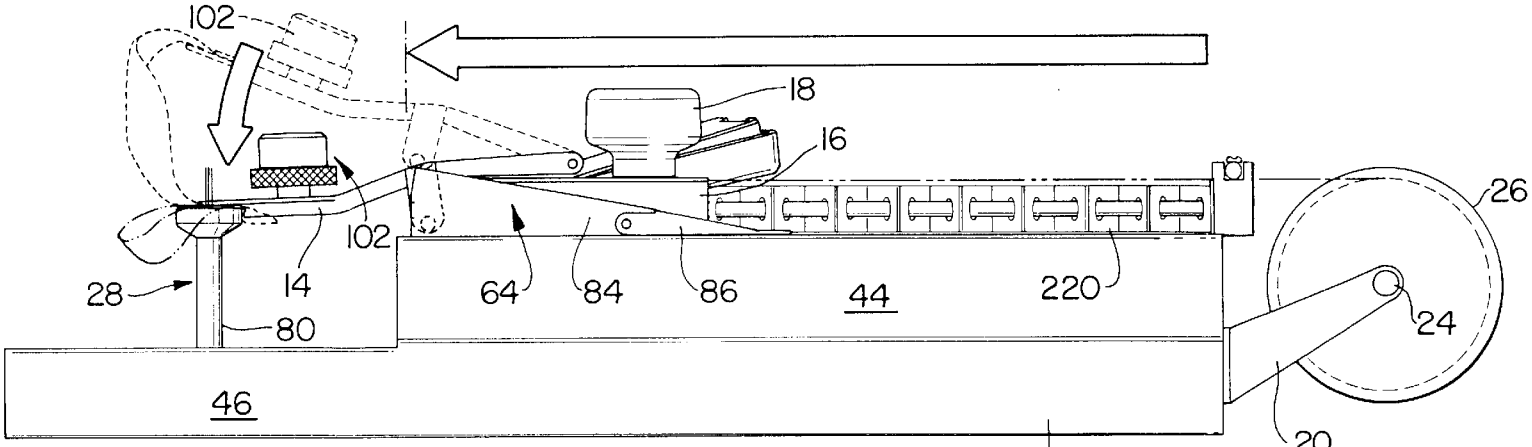
FIG. 3 is a view in elevation identical to FIGS. 1 and 2 when the operation is at the end of the stroke and the first loop of the ribbon is folded and dropped into place on the impaler needles.
Figure 14:
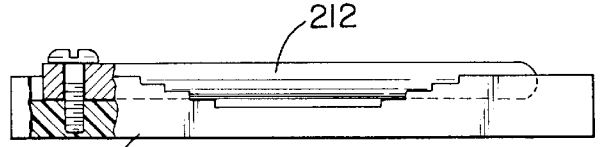

As seen in FIG. 1 the carriage is at the beginning of the stroke (forward stroke) and at this part of the translation of carriage 16 the clapper 14 is in the down position resting on the top of carriage 16 and the cam follower 56 is at a position generally below the inclined surface 62. As the carriage progresses forward to say, the mid-stroke position, as seen in FIG. 2, the impaler has traversed a portion of the inclined surface 62 which serves to raise the impaler to a higher position that is well above the higher level 44. Further positioning of the carriage 16 will cause the cam follower 56 to proceed to the end of the inclined surface 62 and a further movement causes the impaler to immediately drop by the action of gravity. The clapper 14 carries a relatively flat plate 70 at the aft end 72 with a central end slot 74 that is oriented relative to the needles 76 of the impaler needle assembly 28. The needles are mounted vertically and in this embodiment consists of three needles located in a relatively triangular array and serve to hold and rotate the ribbon when the spindle 80 is rotated as will be explained in more detail in the description to follow. Obviously, any other type of needles may be utilized so long as when the ribbon is forced through the needles the ribbon will rotate with the spindle. When the impaler drops the slot 74 straddles the needles and delivers the ribbon to be penetrated by the needles 76.

In the return of the clapper 14 and carriage 16 (reverse stroke), the impaler and carriage are translated in the reverse direction to be returned to the original beginning position. This rectilinear motion is all that is required by the user. The ribbon will be automatically formed into the bow by the operation of the bow making machine. In one instance, the user may wish to have the first loop in a given location in the bow and if this is the case, the user has the option of rotating the spindle by hand to locate the loop of the bow in the desired position.

Figure 4:
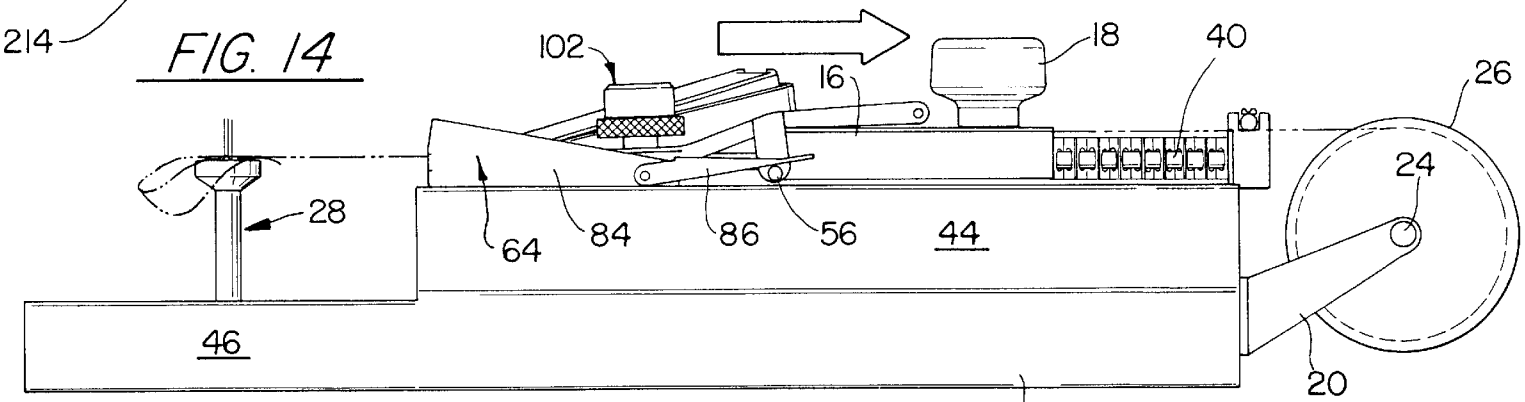
FIG. 4 is a view in elevation identical to FIGS. 1, 2 and 3 where the operation is on mid-stroke of the return stroke.

Cam 64 is formed from two pieces, a fixed portion 84 and a movable portion 86 that is hingedly connected to the fixed portion 84. As noted in the above paragraph the cam 64 is made in a generally "Z" shape. This allows the cam follower 56 to ride underneath the cam surface 62 and when it approaches the end of the cam at the movable portion 86 it will cause the movable portion to rise out of the way of the cam follower 56 as it proceeds toward the beginning stroke (FIG. 4)

What has just been described is the simple two stroke operation of the carriage 16 that carries the clapper 14 that rises by virtue of the cam 64 and drops onto the needle impaler assembly 28. Hence, the operator merely has to move the carriage rectilinearly and the handle 18 provides for easy gripping of the carriage and movement thereof The bow making machine carries the necessary clutches that firstly, allows the ribbon to be moved forwardly a given distance before the spindle 80 is rotated. This is movement is provided by virtue of the ribbon feed clutch generally illustrated by reference numeral 90 to be described hereinbelow. The spindle begins its rotation after the proper amount of ribbon has been advanced by the ribbon feed clutch.

The drive clutch generally illustrated by reference numeral 92 serves to timely rotate the spindle 80 as will be described hereinbelow. A third clutch which is the no-back clutch generally indicated by reference numeral 94 assures that the belt 96 doesn't move in the reverse direction on the return stroke of the carriage 16 which will be described in more detail hereinbelow.

It will become apparent from the description that the bow is formed by the advancement of the carriage during the forward stroke by virtue of the timely positioning of the ribbon, the timely rotation of the spindle and the timely dropping of the impaler. The next portion of the description of this invention will be devoted to the clutch mechanism and the sequence of operation to form the bow.

To appreciate the operation of the bow making machine and the timely sequence of the clutch operation, this portion of the description will first detail the threading of the ribbon and then, discuss the clutching mechanism in connection with the making of the bow. As noted above the spool of ribbon which is commercially available in spools is mounted on the axel 24 which is easily removable from the trunnions of the brackets. The ribbon is fed over the top flat wall 32 and under the guide plate 55 that is spaced and parallelly disposed thereto and attached on one edge to the carriage 16. Thus, the ribbon is fed through this feed channel formed between the top flat wall 32 and underside of guide plate 55. The clapper 14 carries a similar feed channel formed between the underside of the impaler plate 98 and the upper surface of guide plate 100 which is suitably attached at one edge to the impaler plate 98 to form the feed channel. Slot 74*a* formed in guide plate 100 compliments and aligns with slot 74. A guide for accommodating varying ribbon widths may be provide and this is generally illustrated by reference numeral 102. Guide 102 consists of a knurled knob 104 threaded to the shaft 106 and rotated therewith. Shaft 106 carries a pair of generally flat guide members 107 that are suitably rotated by shaft 106 through eccentric mounted pin connection 105. Each guide member 107 has a depending arm 109 at the end thereof that fits into slots 111 formed transverse to the axis of the shaft 106 and the shape of the depending arms 109 is contoured to define an open ended channel that guide the ribbon. Rotation of knob 104 in either the clockwise or counterclockwise direction causes the two guide members to move toward or away from each other to engage the side edges of the ribbon. Thus, these guide members are adjusted to the width of the ribbon and once adjusted the end cap 108 threadably fitted to shaft 106 locks the knurled knob 104 in place. The end cap 108 serves both as a lock nut and as a weight for the clapper 14.

Starting the operation of the bow making machine the carriage is at the fore end of the forward stroke, i.e. the beginning, as shown in FIG. 1. The ribbon feed clutch 90 supported to the carriage 16 engages the ribbon and frictionally pulls the ribbon forward noting that the spool of ribbon is free to rotate about the axle 24. The amount of the ribbon brought forward by virtue of the ribbon feed clutch 90 and the partial stroke of the carriage 16 will determine the size of the loop. This size is adjustable as will be explained hereinbelow. The next portion of the disclosure is directed to FIGS. 8*a*, 8*b* and 9 which describe the ribbon feed clutch mechanism.

Figure 8A:
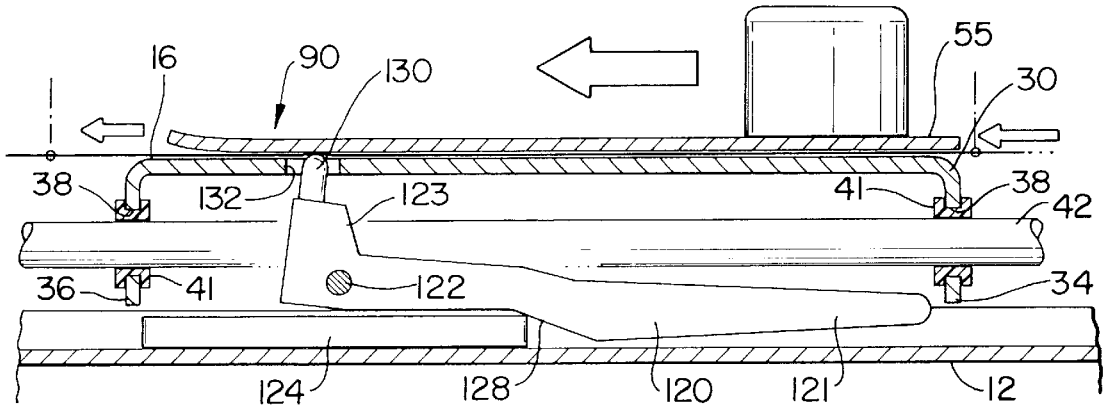
FIG. 8*a* is a partial view partly in section and partly in elevation illustrating the ribbon feed clutching mechanism in the engaged position.
Figure 8B:
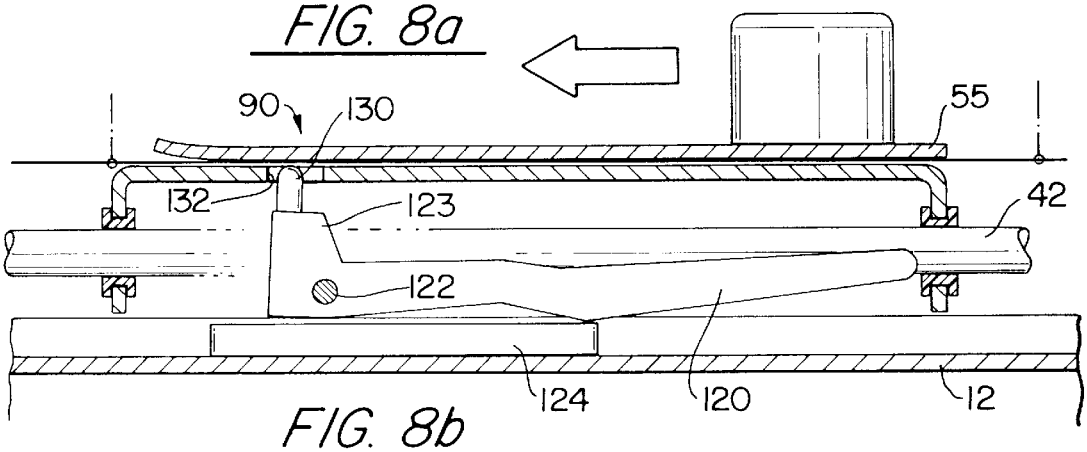
FIG. 8*b* is identical view as depicted in FIG. 8*a* where the clutching mechanism is in the disengaged position.
Figure 9:
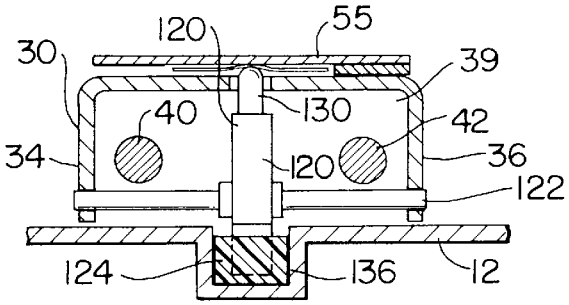
FIG. 9 is an end view in section of the ribbon feed clutching mechanism.
Figure 10:
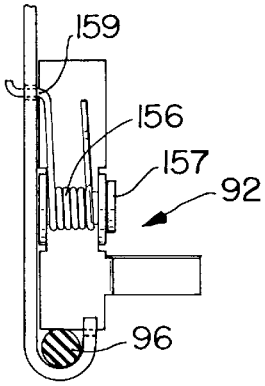
FIG. 10 is an end view in section and elevation of the drive clutch mechanism.
Figure 11:
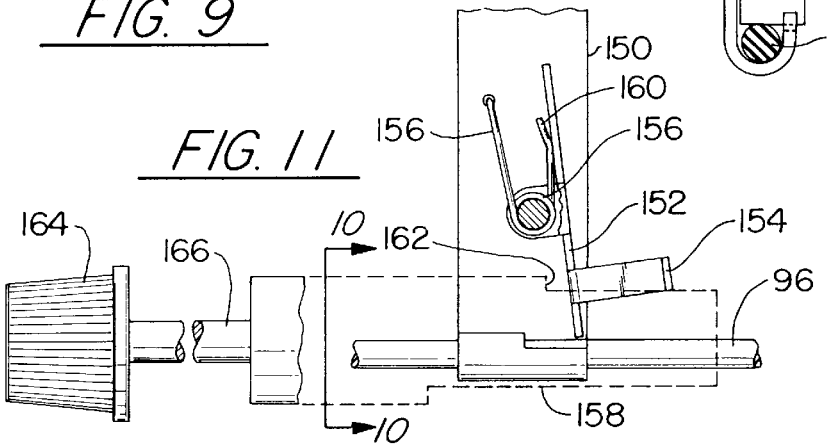
FIG. 11 is a side view in section and elevation of the drive clutch mechanism illustrating the adjustment mechanism for generating the arc of the bow.

As seen in FIG. 8*a*, 8*b* and 9 the carriage is in the forward stroke and the bell crank 120 of ribbon feed clutch 90 is pivotable about axis 122 and one of the arms 121 bears against the adjustable slide member 124. The dimensions of the bell crank arm 120 is selected so that it always has a force tending to move the larger arm 121 in a downward direction. The underside surface 128 is cammed to provide a transition surface to position the bell crank 120 from the downward position as shown in FIG. 1 to the upward position as shown in FIG. 8*b*. As the carriage 16 moves forward the arm 121 of bell crank arm 120 is in the down position and the arm 123 carrying the engagement pin 130 of bell crank 120 that fits through aperture 132 formed in the top wall 32 of carriage 16 to bear against the ribbon with sufficient force to pull the ribbon forward as the carriage moves forward. The pin 130 may be made integral with arm 123. When the transition portion of cam surface 128 of bell crank 120 comes into engagement with slider 124, the arm 121 moves upwardly to pivot the bell crank about pivot 122 and to drop the pin 130 out of engagement with the ribbon so that no additional ribbon is removed from the spool 126. Pivot 122 is supported in the side walls 34 and 36 of carriage 16. Adjustable slider 124 fits into channel 136 formed into the top surface of the upper level 42 of base 12. A suitable crank arm schematically illustrated by reference numeral 140 serves to move slider 124 in channel 136 to change the location of where the bell crank 120 is actuated in order to change the size of the loop of the bow.

The second clutch which is the drive clutch 92 is best seen by referring to FIGS. 5, 6, 7, 10 and 11. As noted in these Figs. a suitable belt 92 is mounted on pulleys 142 and 146 which are mounted on shafts for free rotational movements which shafts are affixed to the base 12. In other words the belt drives the pulleys rather than the pulleys driving the belt. Thus, drive clutch 92 serves to engage and disengage the belt 96 in a timely manner to effectuate rotation of spindle 80 of the spindle assembly 28. The drive clutch 92 is mounted on bracket 150 that, in turn, is attached to the carriage 16 and consists of the actuation arm 152, cam follower 154, torsional coil spring 156 mounted on stub shaft 157 which is supported to the bracket 150 and cam 158. Bracket 150 is bent inwardly on the bottom to form a bottom wall where belt 96 slides freely over. End portion 159 of spring 156 is attached to bracket 150 which serves as a ground and the opposite end portion 160 bears against actuator 152 to urge it toward the right as viewed in FIG. 11 to urge it in a downward direction toward the belt. Cam 158 in the forward stroke is designed to be rectangular in shape and each surface is shaped to have two levels. Cam follower 154 is first on the upper level preventing the actuator 152 from moving toward the right and hence, prevents the arm 152 from engaging the belt 96. Further movement in the forward stroke causes the cam follower 154 to drop off of the upper level to the lower level of cam 158, so that the force generated by spring 156 to urge the actuation arm 152 to bear against the belt 96. Hence, further movement during the forward stroke causes the belt 96 to move in the direction indicated by the arrows. Cam 158 which is a rectangular shaped member with stepped heights defines shoulder 162. The cam 158 is a four sided rectangular member and each side is configured to position the shoulders (similar to shoulder 162) at different locations. Obviously, the cam surface, namely, each of the sides of the four sides locates the shoulder further away from the forward end of cam 158 which determines the time sequence of the rotation of spindle 28 and hence, the amount of generation for determining the angle of rotation or arc of the loop of the bow. Since the cam has four sides there are four steps in setting the cam and preferably the range of the generation of the arc would be between 200°–300°. The knob 164 which is accessible to the user is rotated to the four steps in order to select the desired aesthetics of the bow and it in turn is attached to cam 158 via the shaft 166.

Figure 7:
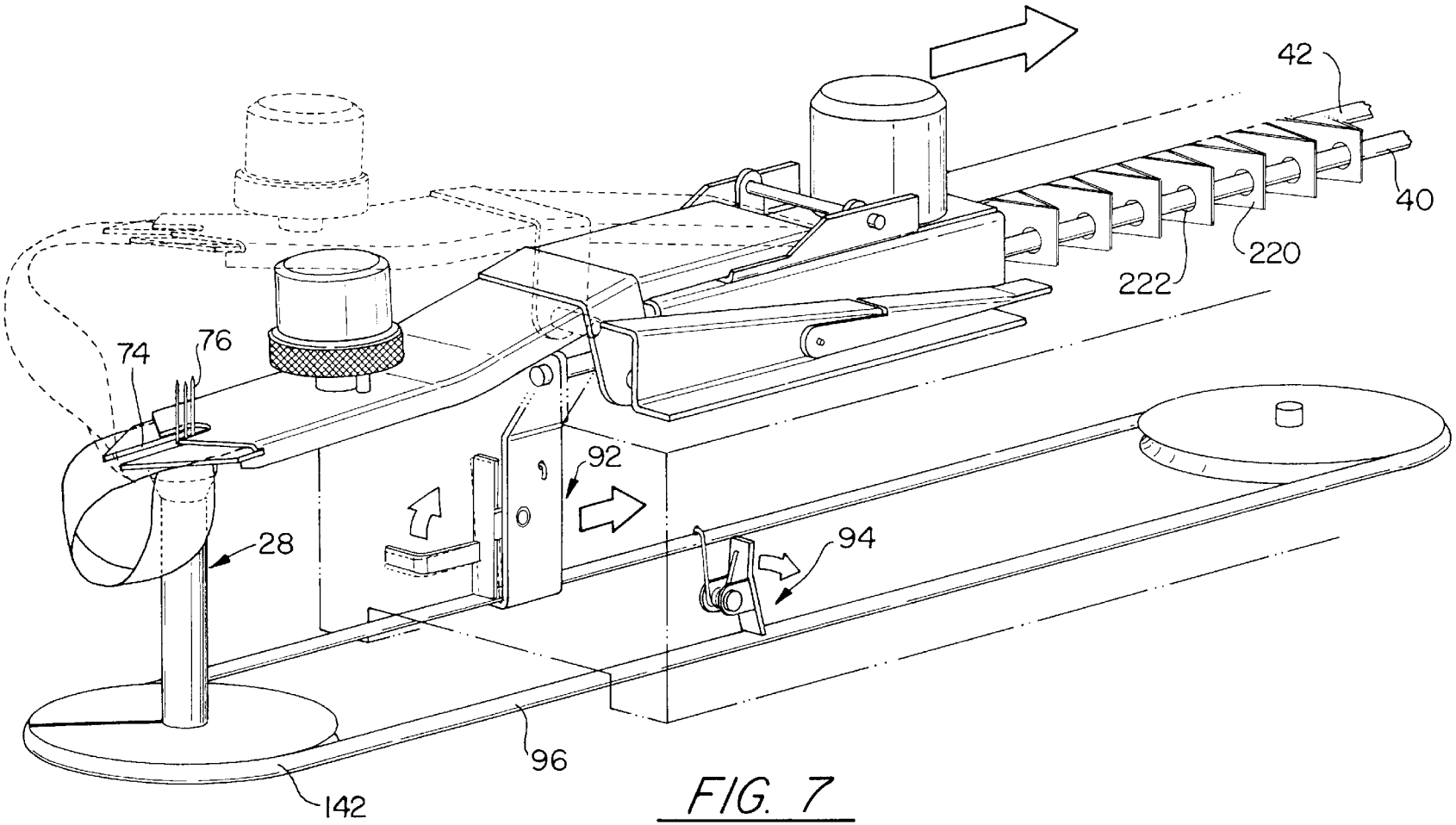
FIG. 7 is a view in perspective and phantom illustrating the operation of the impaling portion of the stroke.

The next portion of the disclosure is directed to the third clutch which is a no-back clutch 94. No-back clutch 94 which is best seen in FIGS. 5 and 7 consists of a torsional coil spring 170 supported to stub shaft 171 affixed to base 12 and having one leg 172 anchored to the base 12 and the other leg 174 bearing against actuator arm 176. The coil spring 170 fits between the bifurcated portion 178 and orients the arm 176 off-center so that in the forward direction the belt slides under the actuation arm 176 and in the rearward direction the belt is prevented from moving since it tends to move the actuation arm 176 in the direction in opposition to the force generated by the spring 170 driving the actuation arm into belt 96 and preventing the belt 96 from moving rearwardly.

Figure 12:
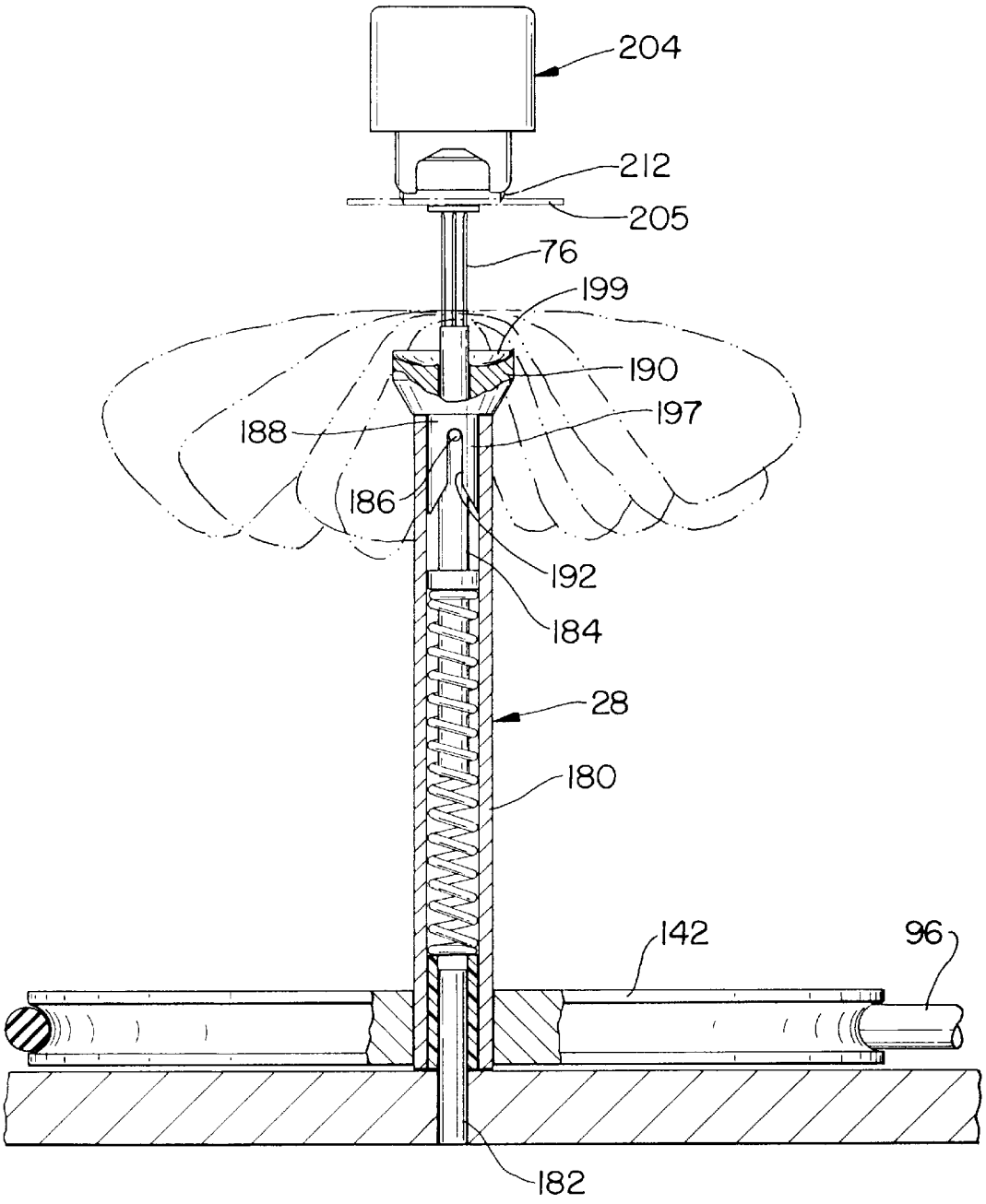
FIG. 12 is a view in phantom, in section and elevation showing the stapler and the details of the impaling needles and mechanism when in the deployed position.
Figure 13:
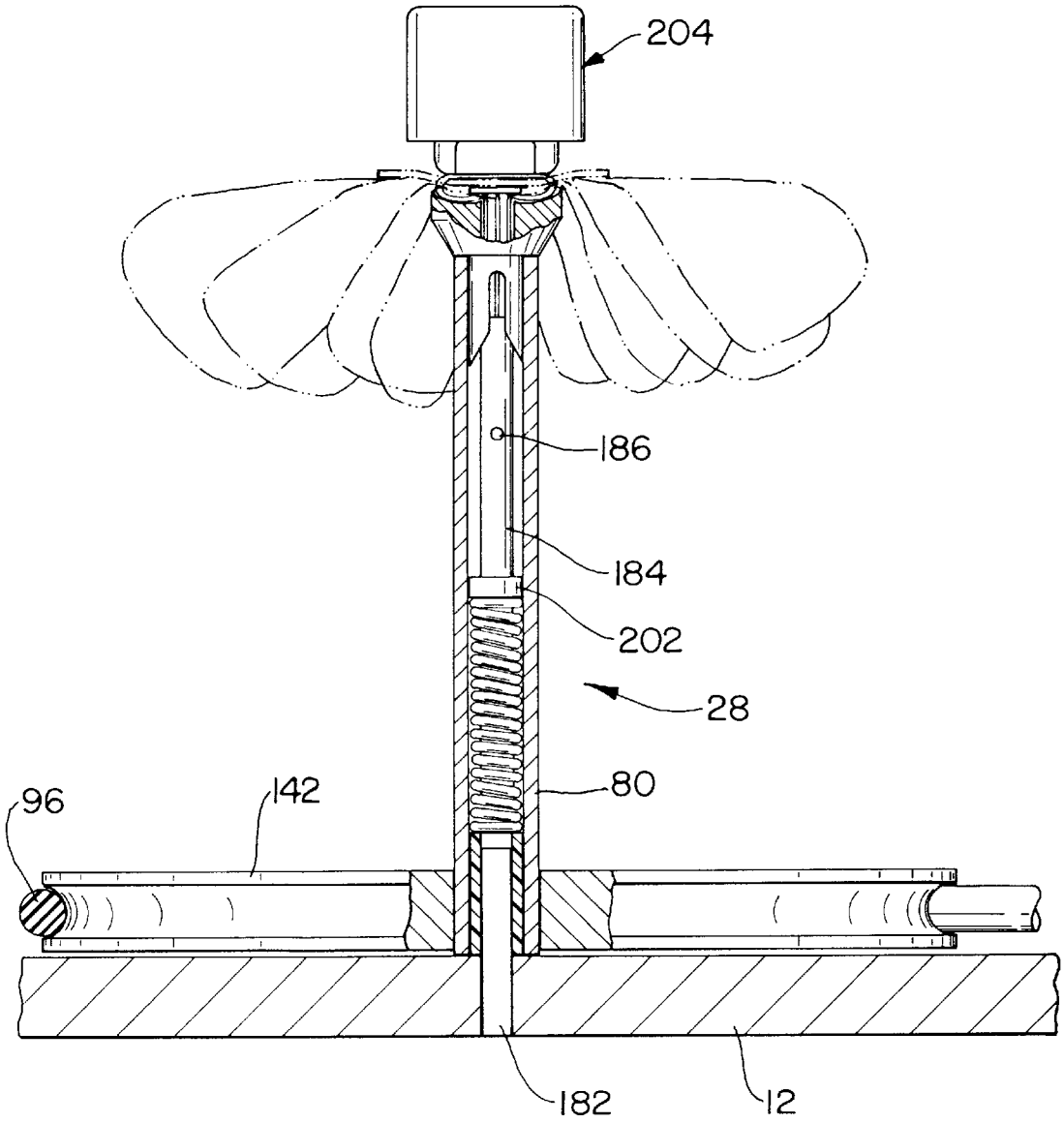
FIG. 13 is identical to FIG. 12 illustrating when the stapler has been depressed and the impaling needles retracted.

The next portion of the portable bow making machine is directed to the spindle assembly 28 which is best seen in FIGS. 5, 6, 7, 12 and 13. As mentioned above, when the drive clutch 92 actuates belt 96, belt 96 drives pulley 142 which is attached to the hollow spindle 80 of the spindle assembly 28 and rotatably supported to the base 12 by stub shaft 182. The impaler needles 76 are affixed to the slidable rod 184 with the points of the needle at the upper end. Rod 184 includes a guide pin 186 extending laterally therefrom that fits into the end cap 188 which includes a head 190 and a reduced diameter portion 199 affixed to the inner diameter of the spindle 80. Axial slot 192 formed in the end of end cap 194 accommodates pin 186 and prevents the head 190 from rotating relative to the spindle. The end of end cap 188 is contoured preferably in a negative partial torroidal shape 199 to guide and clinch the staple in the fastened position that fastens the bow and card together. Coil spring 200 retained at the bottom end by the end of stub shaft 182 bears against the increased diameter end 202 of rod 184 to bias the needles in the deployed position as shown in FIG. 12. The stapler generally illustrated by reference numeral 204 serves to press against the end of the needles 76 and force the rod 184 downwardly to retract the needles 76 within the spherical contour. The stapler 204 serves a multiple purpose as will be described in more detail hereinbelow.

A journal bearing 192 at the stub shaft 182 may be used to assure ease of rotation of the spindle 80. As is apparent from the foregoing, in operation, the pulley 142 driven by the belt 96 rotates the hollow spindle 80 around stub shaft 182 causing the impaler needles 76 and end cap 190 to rotate putting the loop into the ribbon. At this point of the operation where the cam follower 56 of clapper 14 had reached the end of cam 64 and the clapper 14 drops vertically the ribbon impacts the impaler needles 76 the driver clutch becomes disengaged and pulley 142 stops to rotate the spindle 80 and obviously, the ribbon carried by the impaler needles 76.

Since the ribbon is relatively flexible and it is desired in the operation of the bow making machine to keep the ribbon from dropping into the rails 40 and 42 fore and aft of carriage 16 a flexible thin plastic material is folded in an accordion shape and retained in sliding position by the rails and serve to prevent the ribbon from dropping into this space. Also a tension device or hold-back generally indicated by reference numeral 210 is attached to the fore end of the base 12 and carries a bar 212 extending horizontally and fits over a space in the support block 214. The bar is attached to the support block at one end to allow for ease of threading the ribbon between the bar 212 and the support block 214. This places some friction on the ribbon and maintains a tension load thereon. Obviously, if needed, any other suitable mechanism for applying a tension to the ribbon as it passes through the bow making machine can be utilized. The hold-back 210 assures that when the ribbon feed clutch 90 disengages the ribbon will be taut and will not be advanced by the ribbon feed clutch.

In the event the ribbon has a tendency to fall inwardly toward the rails, a filler 220 may be inserted in the open space adjacent the rails. The filler 220 is an accordion pleated plastic material that is fitted into the rails 40 and 42 via the holes 222 in the filler 220. The filler merely compresses and expands with the stroke to assure that the space is always filled.

Operation

Now that the details of the invention has been described, the next portion of this description will detail the operation of making a bow by use of the inventive bow making machine. The spool 26 with the desired color and width of the ribbon is mounted on the brackets 20 for free rotation. The ribbon is threaded through the tension device 210, through the channels in the carriage 16 and clapper 14. The operator, adjusts the knurled knob 104 to adjust the width guides to the width of the ribbon. If required, the operator also selects the desired loop size by adjusting the position of slider 124 and the desired generation angle (loop) by adjusting knob of the arc generation cam 158. Once threaded to the end of the clapper 14, the carriage, if not at the beginning of the stroke, is returned to the beginning of the base 12 or the far right end as shown in FIG. 1. By use of the handle 18 the carriage 16 and clapper 14 are translated forward so that the cam follower 56 rides up the inclined cam surface 62 of cam 64 causing the clapper 14 to rise above the upper level 44. At the immediate portion of the forward stroke, the ribbon feed clutch 90 is in the engaged position and the ribbon moves forward along with the clapper 14 until it attains the selected length. At this juncture of the stroke, the ribbon clutch 90 becomes disengaged. At the beginning of the stroke the drive clutch 92 is in the disengaged position until it becomes engaged when it is actuated by the selected lobe of cam 158 and the belt 96 is now driven in the direction indicated by the arrows in the Figs. As the clapper 14 is moved forward in the forward stroke movement and continues the ride up the inclined surface of cam 64 and until the clapper 14 reaches the end of the stroke the loop of the bow is formed (FIGS. 3, 4, 6 and 7) and the clapper 14 will drop onto the impaler needles 76. The carriage 16 and clapper 14 is then returned to the start position of the stroke. Hence, the stroke consists of a forward stroke and a rearward stroke, noting that in the rearward stroke the cam follower 56 rides under the cam 64 and the movable portion 86 moves upwardly out of the way to permit the cam follower 56 to continue the reverse stroke. The stroke is then repeated and continues until the desired number of loops are formed. After the required number of loops are attained the stapler 204 is placed in position and loaded with a self gluing card by the user it is actuated to staple the bow and the self-gluing card.

The remaining portion of this description will describe the stapler 204 and its operation. The stapler is a commercially available stapler that has been uniquely modified to accommodate the bow making machine. A spring clip 210 made from a suitable flexible material, is attached at one end to the underside of the stapler and is dimensioned so that its width is selected to fit between the ends of the commercially available staple 212 of the stapler 204. The end of the spring clip 210 is opened so that the self-gluing card 205 with the glue face facing upwardly is placed in the space formed between the bottom wall of the stapler 204 and the upper surface of the spring clip 210. The stapler is suitably attached to the bow making machine and it being of the type that is hinged so that the gun is movable relative to the base of the stapler, the gun which is normally placed out of position is moved into position so that the staple aligns with the head 190 of the spindle assembly 28 when the bow making operation is completed. The user then forces the head of the stapler 204 downwardly. This serves several functions. First, it forces the impaler needles 76 downward to retract them into the hollow space of the spindle 80, places the self-gluing card 205 adjacent to the bow and locates the ends of the U-shaped staples in alignment with the stapler anvil 190. Secondly, further depressing of the gun staples the self-gluing card to the bow. Once the staple penetrates the self-gluing card and bow the ends of the staple ride along the contoured surface 199 of the anvil 190 to force the ends of the staple to the clinched position. The stapler is then moved out of the way. The user has the option of cutting the end the ribbon before or after the bow is stapled. The bow which is now a finished product is then removed from the spring clip 210 merely by sliding it off. Obviously, if the same spool of ribbon is to be used the forward and rearward strokes merely are repeated. If other ribbons are used, the machine needs to be retreaded and the operation as described above repeated.

What has been shown by this invention is a portable bow making machine capable of use by a consumer that not only is simple to operate, but is inexpensive and durable. Once the ribbon is threaded to the machine and the loop size and arc generation is selected, the operator merely has to stroke the carriage in a rectilinear motion and the bow is automatically made. The removal, the stapling of the self-gluing card is a relatively simple operation.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. A portable bow making machine for making a bow from ribbon comprising a base having a first portion and a second portion, said first portion having a fore end and an aft end, a rail supported to said base extending longitudinally therebetween, a manually operated carriage mounted on said rail for rectilinear movement, a clapper hingedly supported in axial alignment to said carriage, said second portion having an impaler attached to said base adjacent said aft end and extending vertically, said clapper being sufficiently heavy to drop on said impaler when said carriage positions said clapper directly thereover, a longitudinal open-ended channel on the underside of said carriage and said clapper and movable therewith for leading a portion of said ribbon from said fore end to said impaler, a first clutch carried by said carriage engageable with said ribbon for advancing said ribbon a predetermined distance, a belt connected to said impaler for imparting rotary motion thereto, a second clutch operatively connected to said belt for rotating said impaler a predetermined distance when said portion of said ribbon is dropped on and penetrated by said impaler for generating an arc on said ribbon, and a third clutch operatively connected to said belt for preventing said belt from moving in a single direction when said carriage is returned to said fore end.

2. A portable bow making machine as claimed in claim 1 including a free rotating reel mounted on said fore end of said first portion for holding a roll of said ribbon.

3. A portable bow making machine as claimed in claim 2 including a frictional device included in said longitudinal open-ended channel attached to said fore end of said base between said reel and said carriage.

4. A portable bow making machine as claimed in claim 3 wherein said impaler includes a three vertically extended needle formed in an array to hold said portion of said ribbon when said portion is penetrated thereby for rotating said portion of said ribbon.

5. A portable bow making machine as claimed in claim 4 wherein said impaler includes a cylindrical housing, said needles mounted on retractable member supported in said cylindrical casing, and a spring operatively connected to said member to bias said member in an extended position.

6. A portable bow making machine as claimed in claim 5 in combination with a stapler pivotally attached to the aft end of said base and having a head aligned with said needles when positioned over said needles.

7. A portable bow making machine as claimed in claim 6 wherein said stapler includes a flexible spring clip having an attached end attached to said stapler between the spaced openings in the head of the stapler where the staples discharge and an opened end, said opened end for receiving a removable self-gluing card for attaching to said bow.

8. A portable bow making machine as claimed in claim 1 wherein the end of said cylindrical housing defines an anvil with a partial negative torroidal configuration for clinching the staple after penetrating said bow.

9. A portable bow making machine as claimed in claim 8 including a first pulley attached to said cylindrical housing and a second pulley supported to said base for rotary motion and axially spaced from said first pulley, said belt interconnecting said first pulley and said second pulley and being driven by said belt when said second clutch is in engagement.

10. A portable bow making machine as claimed in claim 9 including a cam attached to said aft end of said base, said cam having an inclined cam surface, a cam follower attached to said clapper for riding said cam surface to raise said clapper prior to dropping on said impaler.

11. A portable bow making machine as claimed in claim 10 wherein said cam includes a first portion fixed to said base and a second portion pivotally supported to said fixed portion at the base of said inclined cam surface, said follower bypassing said inclined surface and lifting said second portion when said carriage returns to said fore end.

12. A portable bow making machine as claimed in claim 11 wherein said first clutch is adjustable to adjust the predetermined length of said ribbon portion.

13. A portable bow making machine as claimed in claim 12 wherein said second clutch is adjustable to different arc generations.

14. A portable bow making machine as claimed in claim 13 wherein a portion of said open-ended channel comprises a pair of lateral spaced movable guide plates adjustable to different widths to accommodate different widths of ribbons.

15. In combination, a portable bow making machine for making a bow from ribbon and a stapler comprising a base having a first portion and a second portion, said first portion having a fore end and an aft end, a rail supported to base extending longitudinally therebetween, a manually operated carriage mounted on said rail for rectilinear movement, a clapper hingedly supported in axial alignment to said carriage, said second portion having an impaler attached to said base adjacent said aft end and extending vertically, said clapper being sufficiently heavy to drop on said impaler when said carriage positions said clapper directly thereover, a longitudinal open-ended channel on the underside of said carriage and said clapper and movable therewith for leading a portion of said ribbon from said fore end to said impaler, a first clutch carried by said carriage engageable with said ribbon for advancing said ribbon a predetermined distance, a belt connected to said impaler for imparting rotary motion thereto, a second clutch operatively connected to said belt for rotating said impaler a predetermined distance when said portion of said ribbon is dropped on and penetrated by said impaler for generating an arc on said ribbon, and a third clutch operatively connected to said belt for preventing said belt from moving in a single direction when said carriage is returned to said fore end and a stapler pivotally attached to the aft end of said base and having a head aligned with needles when positioned over said impaler.

16. The combination of claim 15 including a flexible spring clip having an attached end attached to said stapler between the spaced openings in the head of the stapler where the staples discharge and an opened end, said opened end for receiving a removable self-gluing card for attaching to said bow.

17. The combination as in claim 16 wherein said impaler includes a cylindrical housing rotatably mounted in said base, the end of said cylindrical housing defining an anvil with a partial negative torroidal configuration for clinching the staple of said stapler after penetrating said bow.

18. The combination as claimed in claim 15 including a free rotating reel mounted on said fore end of said first portion for holding a roll of said ribbon, a frictional device included in said longitudinal open-ended channel attached to said fore end of said base between said reel and said carriage, wherein said impaler includes three vertically extended needles formed in an array to hold said portion of said ribbon when said portion is penetrated thereby for rotating said portion of said ribbon, said impaler having a cylindrical housing, said needles mounted on retractable member supported in said cylindrical casing, and a spring operatively connected to said member to bias said member in an extended position.

19. The combination of claim 18 including a first pulley attached to said cylindrical housing and a second pulley supported to said base for rotary motion and axially spaced from said first pulley, said belt interconnecting said first pulley and said second pulley and being driven by said belt when said second clutch is in engagement, a cam attached to said aft end of said base, said cam having an inclined cam surface, a cam follower attached to said clapper for riding said cam surface to raise said clapper prior to dropping on said impaler, said cam having a first portion fixed to said base and a second portion pivotally supported to said fixed portion at the base of said inclined cam surface, said follower bypassing said inclined surface and lifting said second portion when said carriage returns to said fore end.

20. The combination as claimed in claim 19 wherein said first clutch is adjustable to adjust the predetermined length of said ribbon portion and said second clutch is adjustable to different arc generations.

* * * * *